US010329968B2

(12) United States Patent
Sato

(10) Patent No.: US 10,329,968 B2
(45) **Date of Patent: *Jun. 25, 2019**

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventor: Kenji Sato, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 113 days.

This patent is subject to a terminal disclaimer.

(21) Appl. No.: 15/509,122

(22) PCT Filed: Aug. 10, 2015

(86) PCT No.: PCT/JP2015/072626
§ 371 (c)(1),
(2) Date: Mar. 6, 2017

(87) PCT Pub. No.: WO2016/047296
PCT Pub. Date: Mar. 31, 2016

(65) Prior Publication Data

US 2017/0292415 A1 Oct. 12, 2017

(30) Foreign Application Priority Data

Sep. 22, 2014 (JP) ..... 2014-192079

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 1/344* (2013.01);
(Continued)

(58) Field of Classification Search
CPC ..... F01L 1/3442; F01L 1/344; F01L 1/047; F01L 2001/34453; F01L 2001/34426;
(Continued)

(56) References Cited

U.S. PATENT DOCUMENTS 8,863,708 B2 10/2014 Watanabe et al.
2002/0078913 A1* 6/2002 Fukuhara ..... F01L 1/344 123/90.17

(Continued)

FOREIGN PATENT DOCUMENTS

JP 2004-116410 A 4/2004
JP 2010-285918 A 12/2010

(Continued)

OTHER PUBLICATIONS

JP 2013-104384 English Language Machine Translation.*

*Primary Examiner* — Mark A Laurenzi
*Assistant Examiner* — Wesley G Harris
(74) *Attorney, Agent, or Firm* — Foley & Lardner LLP

(57) ABSTRACT

In a hydraulically-operated vane rotor equipped variable valve timing control device for an internal combustion engine, a fluid-communication control mechanism is configured to switch, after having started the engine, a communication hole from a communicated state to a fluid-communication restricted state prior to switching operation of a lock mechanism from a lock state in which rotary motion of a vane rotor relative to a housing is restricted to an unlock state in which rotary motion of the vane rotor relative to the housing is enabled. As a result of this configuration, it becomes possible to apply, after having started the engine, an appropriately controlled hydraulic pressure to all of vanes, with hydraulic pressure supplied to either all phase-retard chambers or all phase-advance chambers, thereby ensuring a good control responsiveness of the vane rotor.

14 Claims, 8 Drawing Sheets

(52) U.S. Cl.
CPC ..... *F01L 2001/34426* (2013.01); *F01L 2001/34453* (2013.01); *F01L 2001/34463* (2013.01); *F01L 2001/34466* (2013.01); *F01L 2001/34479* (2013.01); *F01L 2001/34483* (2013.01); *F01L 2250/02* (2013.01)

(58) Field of Classification Search
CPC ..... F01L 2250/02; F01L 2001/34479; F01L 2001/34466; F01L 2001/34463; F01L 2001/34483
See application file for complete search history.

(56) References Cited

U.S. PATENT DOCUMENTS

| | | | | |
|---|---|---|---|---|
| 2009/0288625 | A1* | 11/2009 | Toma | F01L 1/3442 123/90.17 |
| 2010/0313835 | A1* | 12/2010 | Yamaguchi | F01L 1/3442 123/90.15 |
| 2011/0162601 | A1* | 7/2011 | Fujiyoshi | F01L 1/3442 123/90.15 |
| 2011/0259289 | A1* | 10/2011 | Fujiyoshi | F01L 1/3442 123/90.15 |

FOREIGN PATENT DOCUMENTS

| | | | |
|---|---|---|---|
| JP | 2011-231644 | A | 1/2011 |
| JP | 2013-104384 | A | 5/2013 |
| JP | 2013-185442 | A | 9/2013 |

* cited by examiner

VALVE TIMING CONTROL DEVICE FOR INTERNAL COMBUSTION ENGINE

TECHNICAL FIELD

The present invention relates to a valve timing control device for an internal combustion engine for controlling valve timings (i.e., valve open timing and valve closure timing) of intake and/or exhaust valves depending on engine operating conditions.

BACKGROUND ART

One such valve timing control device for an internal combustion engine, has been disclosed in the following prior-art Patent document 1.

That is to say, the valve timing control device disclosed in the Patent document 1, is configured to lock a relative rotation phase of a vane rotor to a housing (a timing sprocket) in a predetermined relative rotation phase relationship between them by engagement of a lock pin during an engine stopping period, thereby improving a startability.

Also provided in the vane rotor is a fluid-communication control mechanism for permitting fluid-communication between a phase-retard side communication passage and a phase-advance side communication passage through an annular groove formed in the outer periphery of a communication pin. For instance, when an engine has stalled with the vane rotor whose relative rotation phase has been kept in a maximum phase-retard state, the fluid-communication control mechanism permits two adjacent hydraulic chambers (that is, a phase-retard side hydraulic chamber and a phase-advance side hydraulic chamber), arranged circumferentially adjacent to each other and defined on both sides of a vane, to be communicated with each other. This increases a fluttering motion of the vane rotor, caused by positive and negative alternating torque transmitted from the camshaft, thereby enabling the vane rotor to be moved to the predetermined relative rotation phase rapidly.

CITATION LIST

Patent Literature

Patent document 1: JP2013-185442 A

SUMMARY OF INVENTION

Technical Problem

By the way, in the previously-discussed prior-art valve timing control device, release (or unlocking) of the lock pin and release of the communication pin are performed by pushing the respective pins away by hydraulic pressures applied to the tips of the pins and acting against the biasing forces of springs biasing these pins respectively.

With the previously-discussed configuration, assuming that the locked state of the lock pin is released prior to shutting off fluid-communication between the adjacent hydraulic chambers by means of the fluid-communication control mechanism, it is impossible to apply a satisfactorily controlled hydraulic pressure to the vane rotor, and thus there is a possibility for the control responsiveness of the vane rotor to be degraded after having restarted the engine.

It is, therefore, in view of the previously-described drawbacks of the prior art, an object of the invention to provide a valve timing control device for an internal combustion engine capable of ensuring the improved control responsiveness after having restarted the engine.

Solution to Problem

In order to accomplish the aforementioned and other objects, according to the present invention, a valve timing control device for an internal combustion engine, includes a housing adapted to be driven by torque transmitted from a crankshaft and having a plurality of shoes formed to protrude radially inward from an inner periphery of the housing for partitioning an internal space into a plurality of working chambers, a vane rotor having a rotor configured to rotate relatively to the housing and a plurality of vanes fixedly connected to a camshaft together with the rotor and formed to protrude radially outward from an outer periphery of the rotor for partitioning the working chambers into phase-retard chambers and phase-advance chambers in cooperation with the shoes, a lock mechanism interposed between the vane rotor and the housing for restricting rotation (rotary motion) of the vane rotor relative to the housing depending on an engine operating condition, and a fluid-communication control mechanism having a communication hole formed in at least one of the plurality of vanes so as to permit fluid-communication between the phase-retard chamber and the phase-advance chamber defined by the at least one vane through the communication hole, and configured such that a state of fluid-communication of the communication hole is switchable. The communication hole is switched to a fluid-communication restricted state by the fluid-communication control mechanism at a relatively earlier time than restriction release (unlocking) of the lock mechanism.

Advantageous Effects of Invention

According to the present invention, it is possible to control or switch the communication hole to its fluid-communication restricted state at an earlier time than restriction release (unlocking) of the lock mechanism, thereby enabling application of an appropriately controlled hydraulic pressure during valve timing control after having restarted the engine. As a result, it is possible to ensure the improved control responsiveness.

BRIEF DESCRIPTION OF DRAWINGS

FIG. 6 illustrates a vane-rotor maximum phase-retard state, and FIG. 6A is a lateral cross-sectional view taken along the line A-A of FIG. 2 under the maximum phase-retard state, whereas

FIG. 7 illustrates a vane-rotor lock state, and FIG. 7A is a lateral cross-sectional view taken along the line A-A of FIG. 2 under the vane-rotor lock state, whereas

FIG. 8 illustrates a vane-rotor maximum phase-advance state, and FIG. 8A is a lateral cross-sectional view taken along the line A-A of FIG. 2 under the maximum phase-advance state, whereas

FIG. 9 illustrates the second embodiment according to the invention, and FIG. 9A is a view corresponding to FIG. 4 that shows the longitudinal cross-section of a lock mechanism, whereas

DESCRIPTION OF EMBODIMENTS

Details of the internal combustion engine valve timing control device of each of the embodiments according to the invention are hereinafter described in reference to the drawings. By the way, in the shown embodiments, the valve timing control device is applied to a valve actuating device of the intake-valve side.

First Embodiment

Figure 1:
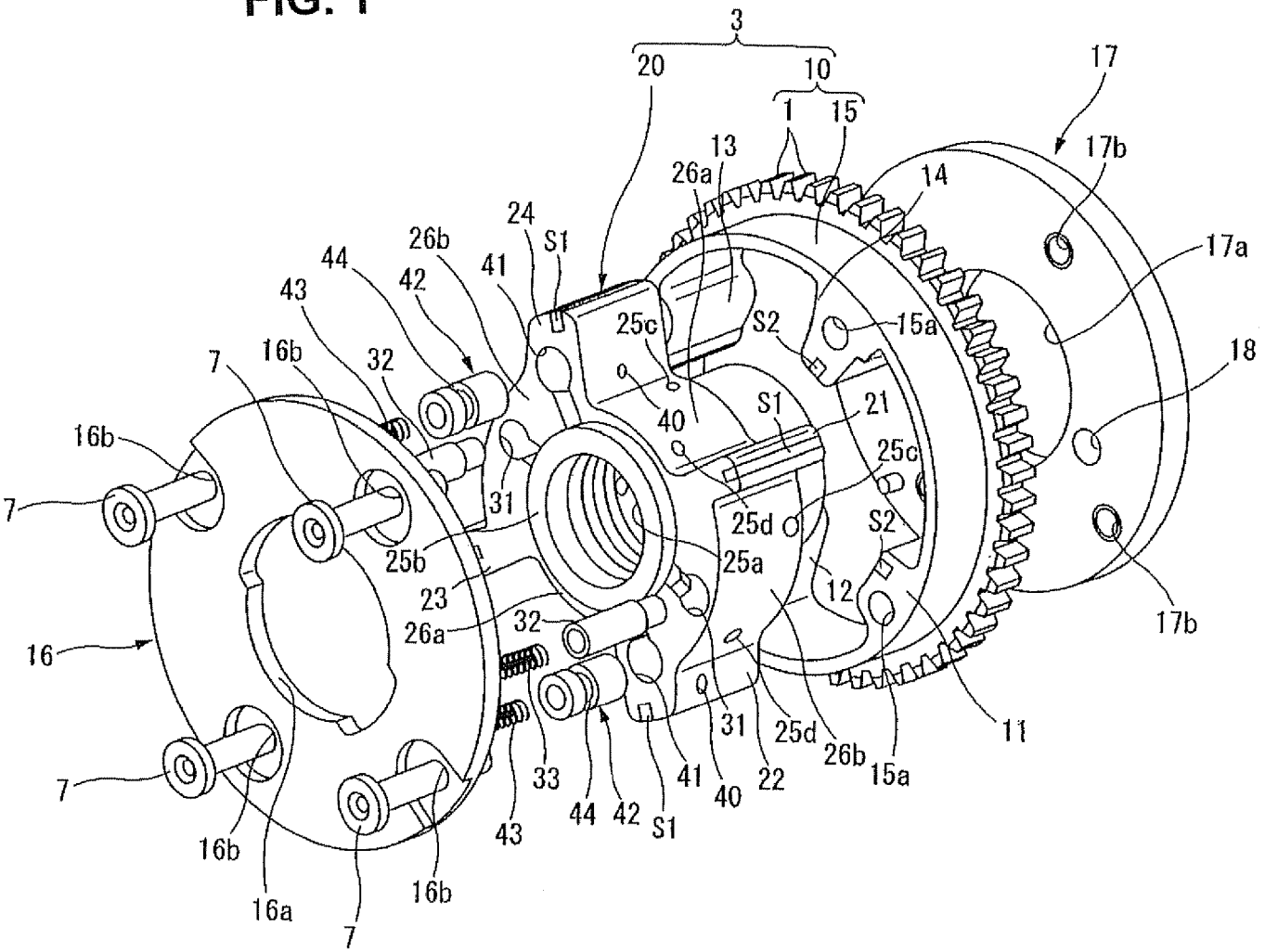
FIG. 1 is a perspective disassembled view illustrating an internal combustion engine valve timing control device of the first embodiment according to the invention.

Referring now to the drawings, particularly to FIGS. 1-8, there is shown the internal combustion engine valve timing control device of the first embodiment according to the invention. As shown in FIG. 1, the valve timing control device of the first embodiment includes a sprocket 1, a camshaft 2, a phase-change mechanism 3, a pair of lock mechanisms 4, 4, a pair of fluid-communication control mechanisms 5, 5, and a hydraulic-pressure supply-discharge mechanism 6. Sprocket 1 is rotated and driven by torque transmitted from a crankshaft (not shown). Camshaft 2 is configured to be rotated relatively to the sprocket 1. Phase-change mechanism 3 is interposed between the sprocket 1 and the camshaft 2 for converting a relative rotation phase between the sprocket 1 and the camshaft 2. Lock mechanisms 4 are configured to restrict relative rotation between the sprocket 1 and the camshaft 2 by locking the phase-change mechanism 3 at a predetermined intermediate angular position. Fluid-communication control mechanisms 5 are configured to control switching between a communicated state and a shut-off state (a fluid-communication restricted state) of each of a first prescribed adjacent pair (Re2, Ad2) of phase-retard chambers Re1-Re4 (described later) and phase-advance chambers Ad1-Ad4 (described later) and a second prescribed adjacent pair (Re4, Ad4). Hydraulic-pressure supply-discharge mechanism 6 is configured to selectively operate the phase-change mechanism 3, the lock mechanisms 4, and the fluid-communication control mechanisms 5 by switching between pressure-supply and pressure-discharge to and from each of the phase-change mechanism 3, the lock mechanisms 4, and the fluid-communication control mechanisms 5.

By the way, the meaning of the previously-noted term "fluid-communication restricted state" includes a slight fluid-communicated state as well as a completely non-communicated state.

Figure 2:
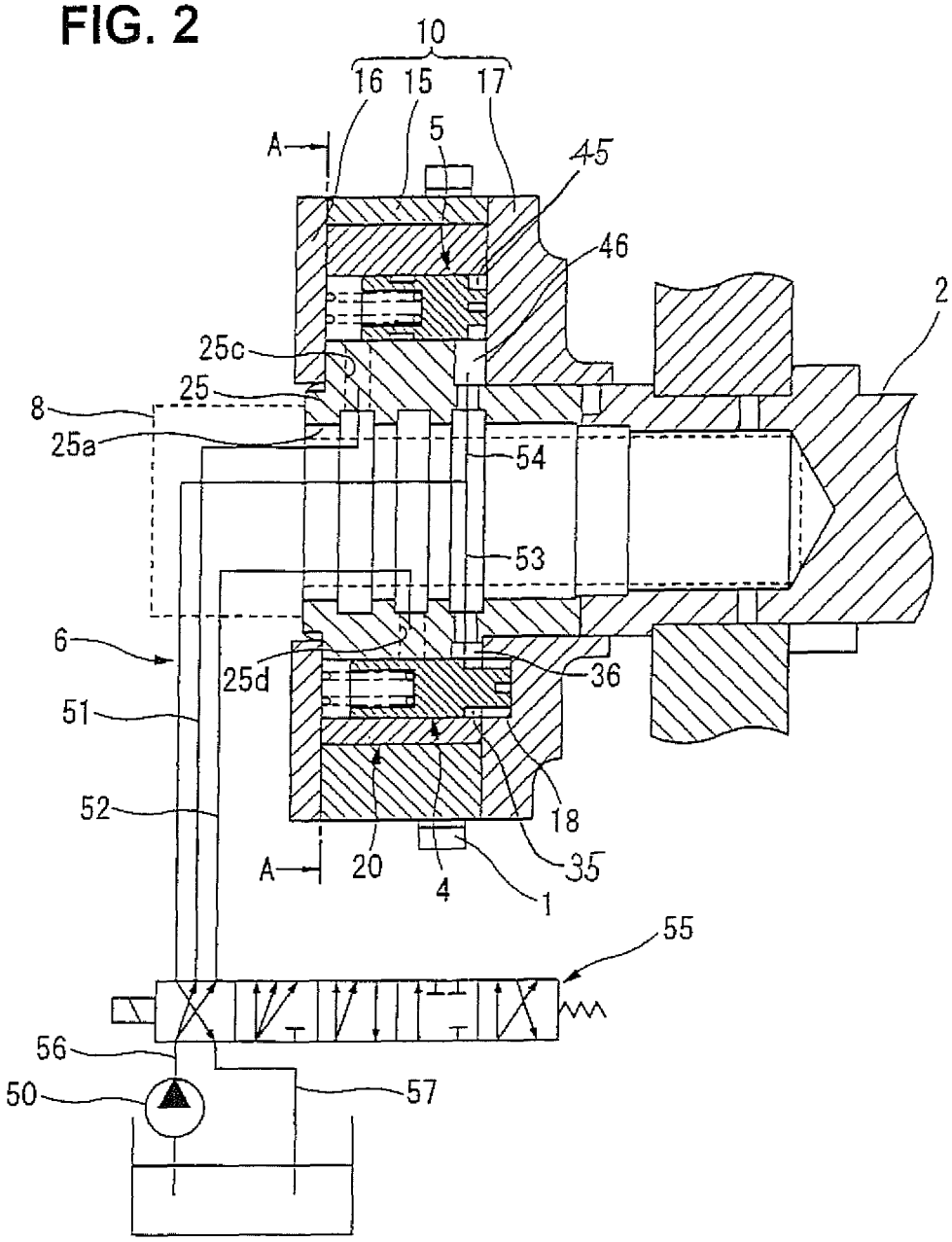
FIG. 2 is a longitudinal cross-sectional view illustrating the internal combustion engine valve timing control device shown in FIG. 1, simultaneously with essential parts of a hydraulic circuit concerned with the valve timing control device.
Figure 3:
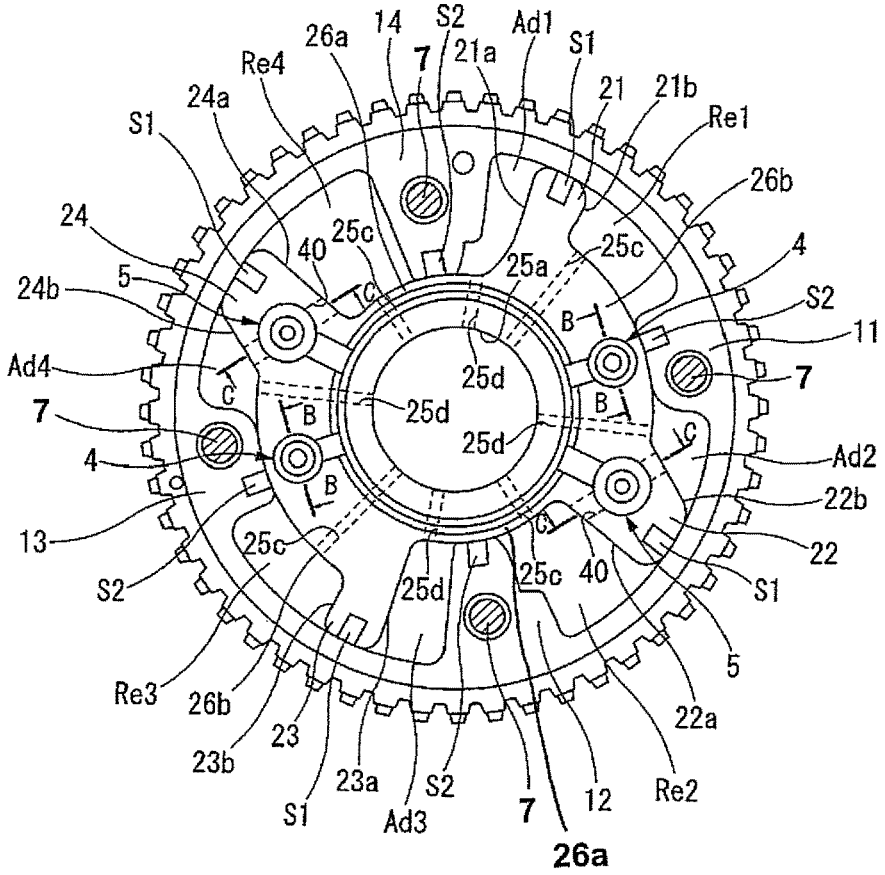
FIG. 3 is a cross-sectional view taken along the line A-A of FIG. 2.

As shown in FIGS. 1-3, phase-change mechanism 3 is comprised of a housing 10, a vane rotor 20, and phase-retard working chambers (that is, a first phase-retard chamber Re1, a second phase-retard chamber Re2, a third phase-retard chamber Re3, and a fourth phase-retard chamber Re4) and phase-advance working chambers (that is, a first phase-advance chamber Ad1, a second phase-advance chamber Ad2, a third phase-advance chamber Ad3, and a fourth phase-advance chamber Ad4). In the first embodiment, housing 10 has four shoes (that is, a first shoe 11, a second shoe 12, a third shoe 13, and a fourth shoe 14) formed integral with the sprocket 1 and configured to protrude radially inward from the inner periphery of sprocket. Vane rotor 20 is rotatably housed in the inner periphery of housing 10 such that relative rotation of vane rotor 20 to housing 10 is permitted. Also, vane rotor 20 is fixedly connected to one axial end of camshaft 2 such that vane rotor 20 can be rotated integrally with the camshaft 2. In the shown embodiment, the internal space, defined between the vane rotor 20 and the shoes 11-14 of housing 10, are partitioned into four phase-retard chambers Re1-Re4 and four phase-advance chambers Ad1-Ad4. The relative rotation phase of vane rotor 20 is controlled by selectively switching between hydraulic-pressure supply to the phase-retard chambers Re1-Re4 and hydraulic-pressure supply (working-fluid supply) to the phase-retard chambers Re1-Re4 by way of the hydraulic-pressure supply-discharge mechanism 6.

Housing 10 is constructed by a substantially cylindrical housing main body 15, a front plate 16 configured to hermetically close the front opening end of housing main body 15, and a rear plate 17 configured to hermetically close the rear opening end of housing main body 15. Front plate 16, housing main body 15, and rear plate 17 are axially fastened together with a plurality of bolts 7 and integrally connected to each other by screwing these bolts 7 into the rear plate 17.

Housing main body 15 is formed of a sintered metal material and formed into a substantially cylindrical shape. As previously discussed, the inner periphery of housing main body 15 is formed integral with radially-inward protruding shoes 11-14, whereas the outer periphery of housing main body 15 is formed integral with the sprocket 1. Each of shoes 11-14 has a bolt-insertion hole (a through hole) 15*a* through which bolt 7 is screwed into the rear plate.

Front plate 16 is formed of a metal material and formed into a comparatively thin-wall disk shape. The center of front plate 16 is formed as a substantially circular cam-bolt receiving bore 16*a* in which the head of a cam bolt 8 is received. Also, front plate 16 has four bolt insertion holes 16*b* formed around the cam-bolt receiving bore 16*a* and circumferentially spaced from each other. When installing the front plate, four bolts 7 are inserted into respective bolt insertion holes 16*b*.

Rear plate 17 is formed of a metal material and formed into a substantially disk shape. The center of rear plate 17 is formed as a substantially circular camshaft-end insertion bore 17*a* into which camshaft 2 is inserted. Also, rear plate 17 has four female screw-threaded holes 17*b* formed around the camshaft-end insertion bore 17*a* and circumferentially spaced from each other. When installing the rear plate, four bolts 7 are screwed into respective female screw-threaded holes 17*b*.

Vane rotor 20 is comprised of a rotor main body 25 and a plurality of vanes (four vanes in the first embodiment). Rotor main body 25 and vanes 21-24 are formed of a metal material. Rotor main body 25 is integrally connected to the axial end of camshaft 2 by means of the cam bolt 8. Rotor main body 25 is formed integral with four vanes (that is, a first vane 21, a second vane 22, a third vane 23, and a fourth vane 24) configured to protrude radially outward from the outer periphery of rotor main body 25 and almost equidistant-spaced from each other at approximately equal intervals, such as 90 degrees, in the circumferential direction. The first vane 21 is configured to be substantially conformable to the space defined between the fourth shoe 14 and the first shoe 11. The second vane 22 is configured to be substantially conformable to the space defined between the first shoe 11 and the second shoe 12. The third vane 23 is configured to be substantially conformable to the space defined between the second shoe 12 and the third shoe 13. The fourth vane 24 is configured to be substantially conformable to the space defined between the third shoe 13 and the fourth shoe 14.

By the way, four shoes 11-14 have respective seal retaining grooves, formed in their innermost ends (apexes) opposed to the rotor main body 25. Seal members (apex seals) S2 are fitted into the respective seal retaining grooves of shoes 11-14 so as to bring these seal members S2 into sliding-contact with the outer peripheral surface of rotor main body 25 (small-diameter portions 26*a* and large-diameter portions 26*b*, described later) of vane rotor 20. In a similar manner to the shoes, four vanes 21-24 have respective seal retaining grooves, formed in their outermost ends (apexes) opposed to the housing main body 15. Seal members (apex seals) S1 are fitted into the respective seal retaining grooves of vanes 21-24 so as to bring these seal members S1 into sliding-contact with the inner peripheral surface of housing main body 15. Accordingly, the spaces defined among the vanes 21-24 are partitioned, in cooperation with the respective shoes, into four pairs of hydraulic chambers, that is, the first phase-advance chamber Ad1 and the first phase-retard chamber Re1, the second phase-advance chamber Ad2 and the second phase-retard chamber Re2, the third phase-advance chamber Ad3 and the third phase-retard chamber Re3, and the fourth phase-advance chamber Ad4 and the fourth phase-retard chamber Re4.

Rotor main body 25 is formed into a deformed cylindrical shape. The center of rotor main body 25 is formed as a cam-bolt insertion hole (an axial through hole) 25*a* into which the shank of cam bolt 8 is inserted. The front end of cam-bolt insertion hole 25*a* is formed as an axially-protruding cam-bolt seat section 25*b* on which the head of cam bolt 8 is seated.

Regarding the rotor main body, the circumference of rotor main body 25 defined between the fourth vane 24 and the first vane 21 and the circumference of rotor main body 25 defined between the second vane 22 and the third vane 23 are formed as a pair of diametrically-opposed, comparatively thin-walled small-diameter portions 26*a*, 26*a*. In contrast, the circumference of rotor main body 25 defined between the first vane 21 and the second vane 22 and the circumference of rotor main body 25 defined between the third vane 23 and the fourth vane 24 are formed as a pair of diametrically-opposed, comparatively thick-walled large-diameter portions 26*b*, 26*b*.

With the previously-discussed configuration of the deformed rotor main body, regarding the vanes 21-24, the pressure-receiving surface area of each of the side face 24*a* of the fourth vane 24 and the side face 21*a* of the first vane 21, both facing the small-diameter portion 26*a* defined between the fourth vane 24 and the first vane 21, and the pressure-receiving surface area of each of the side face 22*a* of the second vane 22 and the side face 23*a* of the third vane 23, both facing the small-diameter portion 26*a* defined between the second vane 22 and the third vane 23, are dimensioned to be greater than the pressure-receiving surface area of each of the side face 21*b* of the first vane 21 and the side face 22*b* of the second vane 22, both facing the large-diameter portion 26*b* defined between the first vane 21 and the second vane 22, and the pressure-receiving surface area of each of the side face 23*b* of the third vane 23 and the side face 24*b* of the fourth vane 24, both facing the large-diameter portion 26*b* defined between the third vane 23 and the fourth vane 24. In other words, the first vane 21 (not equipped with the fluid-communication control mechanism 5) and the third vane 23 (not equipped with the fluid-communication control mechanism 5) are configured such that the summed value of the pressure-receiving surface area of the side face 21*a* of the first vane 21, facing the first phase-advance chamber Ad1, and the pressure-receiving surface area of the side face 23*a* of the third vane 23, facing the third phase-advance chamber Ad3, is set greater than the summed value of the pressure-receiving surface area of the side face 21*b* of the first vane 21, facing the first phase-retard chamber Re1, and the pressure-receiving surface area of the side face 23*b* of the third vane 23, facing the third phase-retard chamber Re3. In contrast, the second vane 22 (equipped with the fluid-communication control mechanism 5) and the fourth vane 24 (equipped with the fluid-communication control mechanism 5) are configured such that the summed value of the pressure-receiving surface area of the side face 22*b* of the second vane 22, facing the second phase-advance chamber Ad2, and the pressure-receiving surface area of the side face 24*b* of the fourth vane 24, facing the fourth phase-advance chamber Ad4, is set less than the summed value of the pressure-receiving surface area of the side face 22*a* of the second vane 22, facing the second phase-retard chamber Re2, and the pressure-receiving surface area of the side face 24*a* of the fourth vane 24, facing the fourth phase-retard chamber Re4.

Also, regarding the deformed configuration of the rotor main body, the side face 24*a* of the fourth vane and the side face 21*a* of the first vane, both facing the small-diameter portion 26*a* defined between the fourth vane and the first vane, are arranged to be circumferentially opposed to each other. The side face 22*a* of the second vane and the side face 23*a* of the third vane, both facing the small-diameter portion 26*a* defined between the second vane and the third vane, are arranged to be circumferentially opposed to each other. Additionally, the side face 21*b* of the first vane and the side face 22*b* of the second vane, both facing the large-diameter portion 26*b* defined between the first vane and the second vane, are arranged to be circumferentially opposed to each other. The side face 23*b* of the third vane and the side face 24*b* of the fourth vane, both facing the large-diameter portion 26*b* defined between the third vane and the fourth vane, are arranged to be circumferentially opposed to each other. Hence, the previously-discussed pressure-receiving surface area differences are canceled. That is, hydraulic pressures (working fluid pressures) acting the vane rotor 20 are totally balanced to each other without undesirably biased hydraulic pressure force.

A plurality of phase-retard side communication holes (radial through holes) 25*c* are formed in the rotor main body 25. A phase-retard side oil passage 51 (described later), which is formed in the camshaft 2, is communicated with phase-retard chambers Re1-Re4 through respective phase-retard side communication holes 25*c*. Thus, working fluid (working oil), which is introduced from the hydraulic-pressure supply-discharge mechanism 6 into the phase-retard side oil passage in the camshaft 2, is delivered into phase-retard chambers Re1-Re4 by way of respective phase-retard side communication holes 25*c*.

In addition to the above, a plurality of phase-advance side communication holes (through holes) 25*d* are formed in the rotor main body 25. A phase-advance side oil passage 52 (described later), which is formed in the camshaft 2, is communicated with phase-advance chambers Ad1-Ad4 through respective phase-advance side communication holes 25*d*. Thus, working fluid (working oil), which is introduced from the hydraulic-pressure supply-discharge mechanism 6 into the phase-advance side oil passage in the camshaft 2, is delivered into phase-advance chambers Ad1-Ad4 by way of respective phase-advance side communication holes 25*d*.

As shown in FIGS. 1-4, each of lock mechanisms 4 is arranged or installed substantially in a middle of the associated large-diameter portion 26*b* and provided to hold a relative rotation phase of vane rotor 20 to housing 10 at a predetermined intermediate angular phase between a maximum phase-retard position and a maximum phase-advance position. That is, each of lock mechanisms 4 is mainly constructed by a pin housing hole (serving as a lock housing hole) 31, a lock pin 32 serving as a substantially cylindrical lock member, and a coil spring 33. Pin housing hole 31 is formed in the large-diameter portion 26*b* as an axial through hole. Lock pin 32 is slidably accommodated in the pin housing hole 31 for restricting rotary motion of vane rotor 20 relative to housing 10 by engagement with an engagement hole 18 recessed or bored in the rear plate 17. Coil spring 33 is interposed between the lock pin 32 and the front plate 16 for permanently biasing the lock pin 32 toward the rear plate 17.

Figure 4:
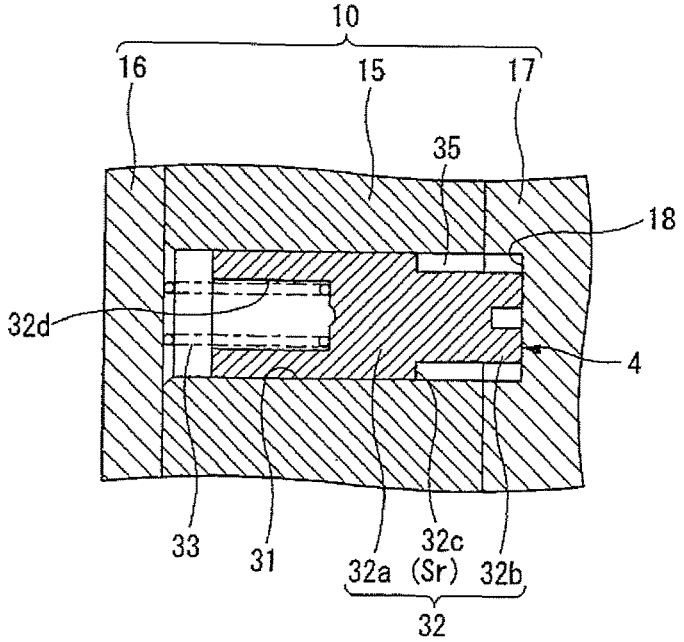
FIG. 4 is a cross-sectional view taken along the line B-B of FIG. 3.

As shown in FIG. 4, lock pin 32 is formed as a stepped cylindrical shape whose diameter decreases toward its front end and which is constructed by a large-diameter portion 32*a*, a small-diameter portion 32*b*, and a stepped or shouldered portion 32*c* between the large-diameter portion 32*a* and the small-diameter portion 32*b*. Under preload, coil spring 33 is elastically installed in a cylindrical-hollow spring housing portion 32*d*, bored in the rear end of large-diameter portion 32*a*. By virtue of the stepped portion 32*c* of lock pin 32, a pressure-receiving chamber 35 is defined between the outer peripheral surface of small-diameter portion 32*b* and the inner peripheral surface of pin housing hole 31. The aforementioned pressure-receiving chambers 35, 35, defined around the small-diameter portions 32*b*, 32*b*, are configured to be communicated with a lock mechanism passage 53 through respective communication grooves 36, 36 cut in the rear end faces of large-diameter portions 26*b*, 26*b*, facing the rear plate 17. Each of lock mechanisms 4 is configured such that lock pin 32 retreats and moves out of engagement with the engagement hole 18 against the spring force of coil spring 33 by applying hydraulic pressure (serving as an unlock pressure) introduced from the lock mechanism passage 53 to the stepped portion 32*c*.

As shown in FIGS. 1-3 and 5, fluid-communication control mechanisms 5 are provided at the second vane 22 and the fourth vane 24, respectively, in a manner so as to penetrate each of the second vane and the fourth vane in their width directions. In the shown embodiment, the first fluid-communication control mechanism 5, provided at the second vane 22, is mainly constructed by a communication hole 40 which is formed in the second vane 22 such that the two adjacent chambers (that is, the second phase-retard chamber Re2 and the second phase-advance chamber Ad2) are communicated with each other through the communication hole 40, a pin housing hole 41, a communication pin 42, and a coil spring 43. Pin housing hole 41 is formed in the second vane 22 as an axial through hole penetrating a substantially midpoint of communication hole 40. Communication pin 42 serves as a valve element slidably accommodated in the pin housing hole 41 of the second vane. Coil spring 43 (serving as a pin biasing member) is interposed between the communication pin 42 of the second vane and the front plate 16 for permanently biasing the communication pin 42 toward the rear plate 17. In a similar manner, the second fluid-communication control mechanism 5, provided at the fourth vane 24, is mainly constructed by a communication hole 40 which is formed in the fourth vane 24 such that the two adjacent chambers (that is, the fourth phase-retard chamber Re4 and the fourth phase-advance chamber Ad4) are communicated with each other through the communication hole 40, a pin housing hole 41, a communication pin 42, and a coil spring 43. Pin housing hole 41 is formed in the fourth vane 24 as an axial through hole penetrating a substantially midpoint of communication hole 40. Communication pin 42 serves as a valve element slidably accommodated in the pin housing hole 41 of the fourth vane. Coil spring 43 (serving as a pin biasing member) is interposed between the communication pin 42 of the fourth vane and the front plate 16 for permanently biasing the communication pin 42 toward the rear plate 17.

As shown in FIG. 3, the communication hole 40 of the second vane 22 is configured such that the side face of the root of the second vane 22, facing the small-diameter portion 26*a*, and the side face of the root of the second vane 22, facing the large-diameter portion 26*b*, are communicated with each other through the communication hole 40. In a similar manner, the communication hole 40 of the fourth vane 24 is configured such that the side face of the root of the fourth vane 24, facing the small-diameter portion 26*a*, and the side face of the root of the fourth vane 24, facing the large-diameter portion 26*b*, are communicated with each other through the communication hole 40. That is, communication hole 40 is configured to be inclined with respect to the width direction (the circumferential direction) of each of the second vane 22 and the fourth vane 24. Hence, as compared to one opening end of communication hole 40, facing the large-diameter portion 26*b*, the other opening end of communication hole 40, facing the small-diameter portion 26*a*, is formed radially inward.

Figure 5:
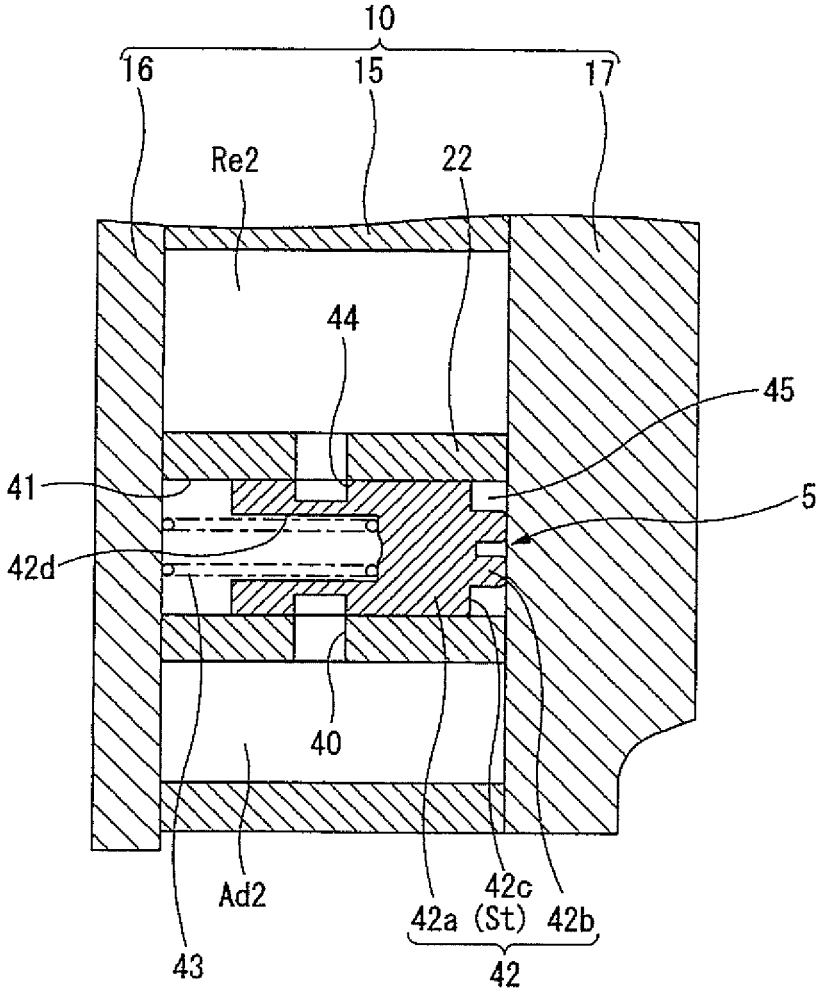
FIG. 5 is a cross-sectional view taken along the line C-C of FIG. 3.

As shown in FIG. 5, communication pin 42 is formed as a stepped cylindrical shape whose diameter decreases toward its front end and which is constructed by a large-diameter portion 42*a*, a small-diameter portion 42*b*, and a stepped or shouldered portion 42*c* between the large-diameter portion 42*a* and the small-diameter portion 42*b*. Under preload, coil spring 43 is elastically installed in a cylindrical-hollow spring housing portion 42*d*, bored in the rear end of large-diameter portion 42*a*. An annular groove 44 is formed or cut around the entire circumference of an axial intermediate section of large-diameter portion 42*a*. The groove width of annular groove 44 is dimensioned to be identical to the inside diameter of communication hole 40. Under a specific condition in which communication pin 42 has moved to its maximum advanced axial position, the annular groove 44 is brought into proper alignment with the communication groove 40 (see FIGS. 6B and 7B). In concert with an increase in retreating-movement of communication pin 42 retreated from the maximum advanced axial position, the opening area of the annular groove opened into the communication hole, in other words, the flow-path cross-sectional area of the communication hole tends to narrow or reduce. Immediately when communication pin 42 has retreated to an axial position greater than a given position, fluid-communication between the communication hole 40 and the annular groove is shut off (blocked) by the outer periphery of large-diameter portion 42*a* of communication pin 42 (see FIG. 8B). As set out above, depending on the flow-path cross-sectional area of communication hole 40 (corresponding to the opening area of the annular groove 44 opened into the communication hole 40), determined depending on the axial position of annular groove, switching between a communicated state and a shut-off state (a fluid-communication restricted state) of the second phase-retard chamber Re2 and the second phase-advance chamber Ad2 and switching between a communicated state and a shut-off state (a fluid-communication restricted state) of the fourth phase-retard chamber Re4 and the fourth phase-advance chamber Ad4 can be controlled.

By virtue of the stepped portion 42*c* of communication pin 42, a pressure-receiving chamber 45 is defined between the outer periphery of small-diameter portion 42*b* and the inner periphery of pin housing hole 41. The aforementioned pressure-receiving chambers 45, defined around these small-diameter portions, are configured to be communicated with a fluid-communication mechanism passage 54 through respective communication grooves 46 cut in the rear end faces of large-diameter portions 26*b*, facing the rear plate 17. Each of fluid-communication control mechanisms 5 is configured such that communication pin 42 retreats against the spring force of coil spring 43 by applying hydraulic pressure, serving as an unlock pressure (i.e., lock-to-unlock switching pressure), introduced from the fluid-communication mechanism passage 54 to the stepped portion 42*c* of communication pin 42.

By the way, communication pin 42 is configured or structured to retreat at an earlier time than retreating-movement of lock pin 32. Concretely, in the shown embodiment, the spring constant (spring stiffness) of coil spring 33 and the spring constant (spring stiffness) of coil spring 43 are set to be identical to each other. Also, the set spring load (in other words, a depth of spring housing portion 32*d* of lock pin 32) of coil spring 33 and the set spring load (in other words, a depth of spring housing portion 42*d* of communication pin 42) of coil spring 43 are set to be identical to each other. In contrast, the pressure-receiving surface area "St" (see FIG. 5) of the stepped portion 42*c* of communication pin 42 is set or dimensioned to be greater than the pressure-receiving surface area "Sr" (see FIG. 4) of the stepped portion 32*c* of lock pin 32.

Returning to FIG. 2, hydraulic-pressure supply-discharge mechanism 6 is mainly constructed by an oil pump 50 serving as a hydraulic pressure source, the phase-retard side oil passage 51, the phase-advance side oil passage 52, the lock mechanism passage 53, the fluid-communication mechanism passage 54, a supply passage 56, and a drain passage 57. Hydraulic-pressure supply-discharge mechanism 6 is provided for selectively switching between working-fluid supply and working-fluid discharge to and from the phase-retard chambers Re1-Re4 and working-fluid supply and working-fluid discharge to and from the phase-advance chambers Ad1-Ad4. Phase-retard side oil passage 51 is provided for pressure-supply and pressure-discharge to and from phase-retard chambers Re1-Re4 through respective phase-retard side communication holes 25*c*. Phase-advance side oil passage 52 is provided for pressure-supply and pressure-discharge to and from phase-advance chambers Ad1-Ad4 through respective phase-advance side communication holes 25*d*. Lock mechanism passage 53 is provided for pressure-supply and pressure-discharge to and from pin housing holes 31 through respective communication grooves 36. Fluid-communication mechanism passage 54 is provided for pressure-supply and pressure-discharge to and from pin housing holes 41 through respective communication grooves 46. Supply passage 56 is provided for selectively supplying hydraulic pressure from oil pump 50 to each of oil passages 51-52 and mechanism passages 53-54 via a generally-known electromagnetic directional control valve 55. Drain passage 57 is provided for draining working fluid (hydraulic pressure) from any one of the phase-retard side oil passage 51, the phase-advance side oil passage 52, and the lock mechanism passage 53 (in other words, the fluid-communication mechanism passage 54 branched from the lock mechanism passage) not connected to oil pump 50 via the electromagnetic directional control valve 55. By the way, the previously-discussed electromagnetic directional control valve 55 is configured to control switching between fluid-communication between oil pump 50 (supply passage 56) and each of oil passages 51-52 and mechanism passages 53-54 and fluid-communication between drain passage 57 and each of oil passages 51-52 and mechanism passages 53-54, responsively to a control current from an electronic control unit ECU (not shown).

Figure 6A:
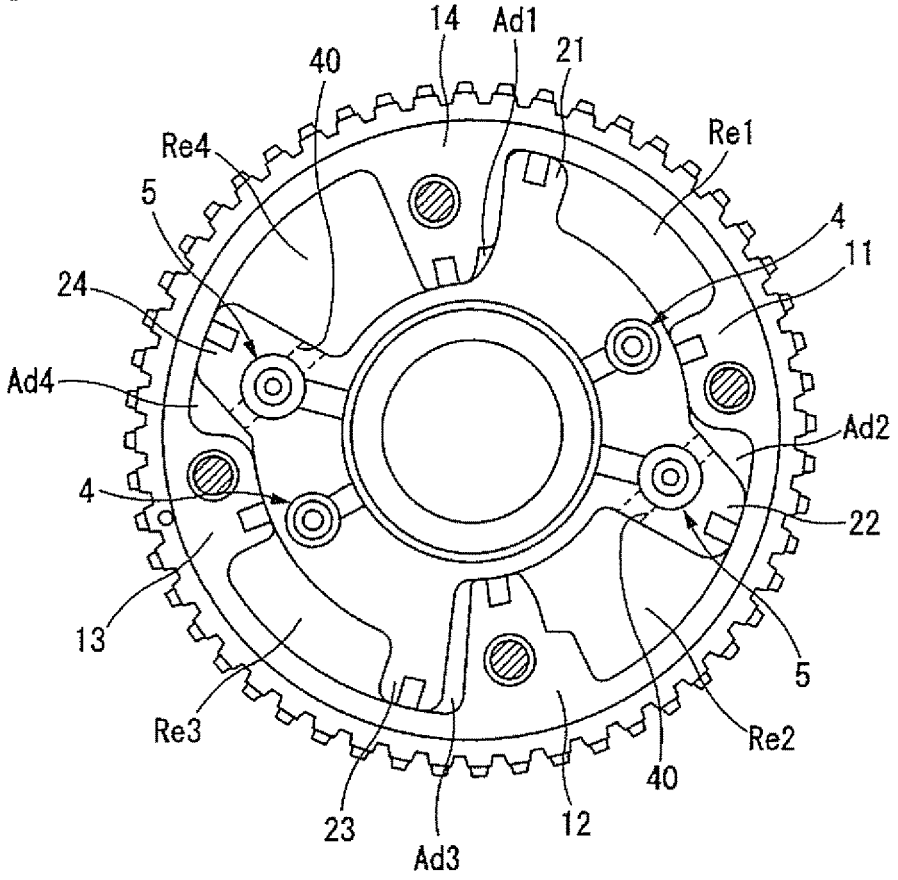
Figure 6B:
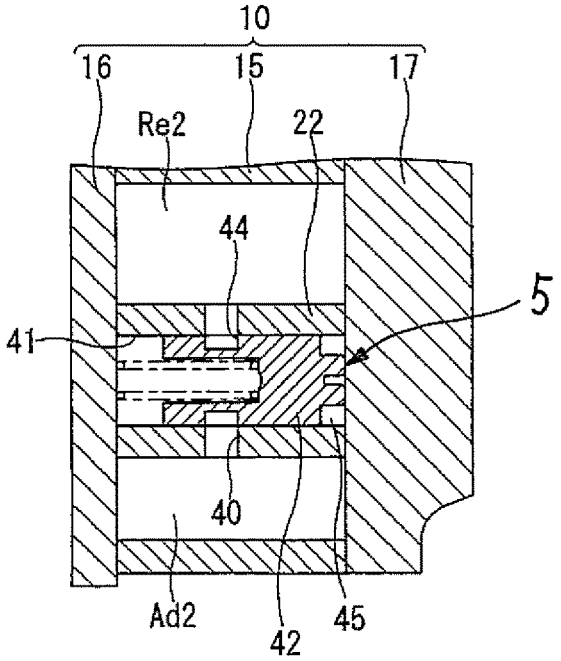
FIG. 6B is a cross-sectional view taken along the line C-C of FIG. 3 under the maximum phase-retard state.
Figure 7A:
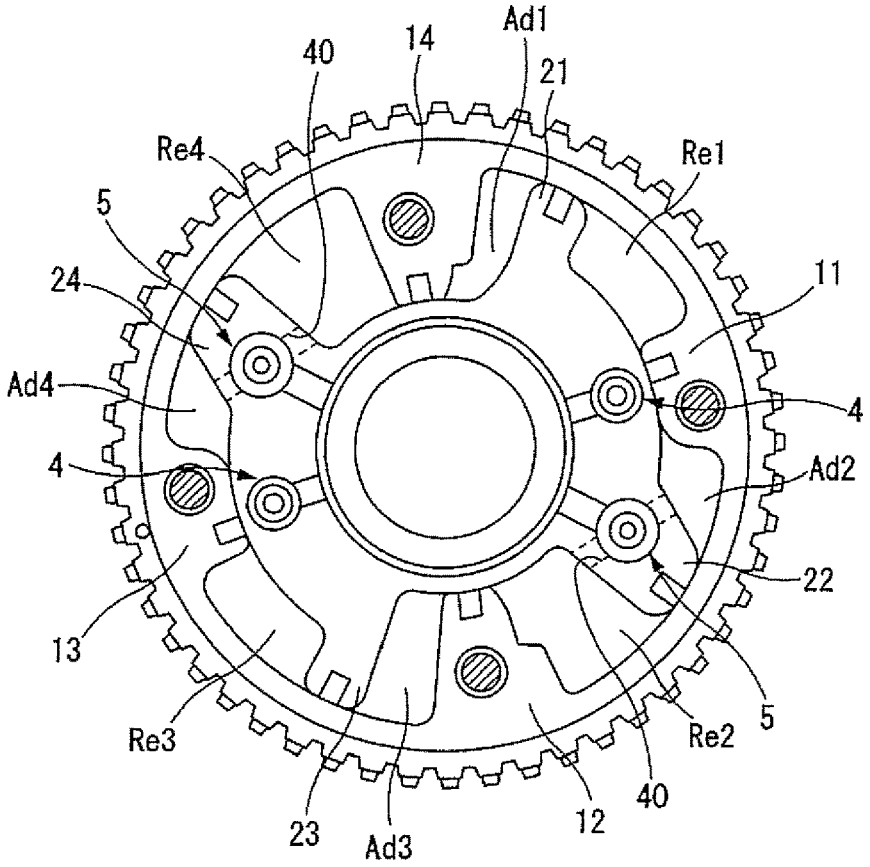
Figure 7B:
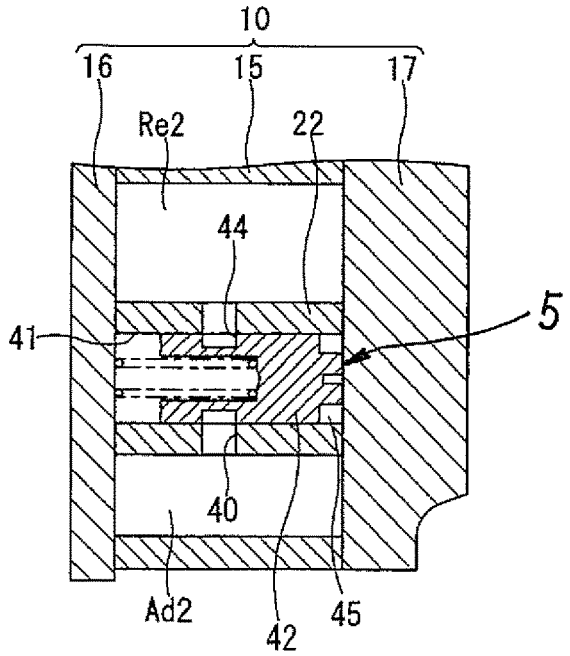
FIG. 7B is a cross-sectional view taken along the line C-C of FIG. 3 under the vane-rotor lock state.
Figure 8A:
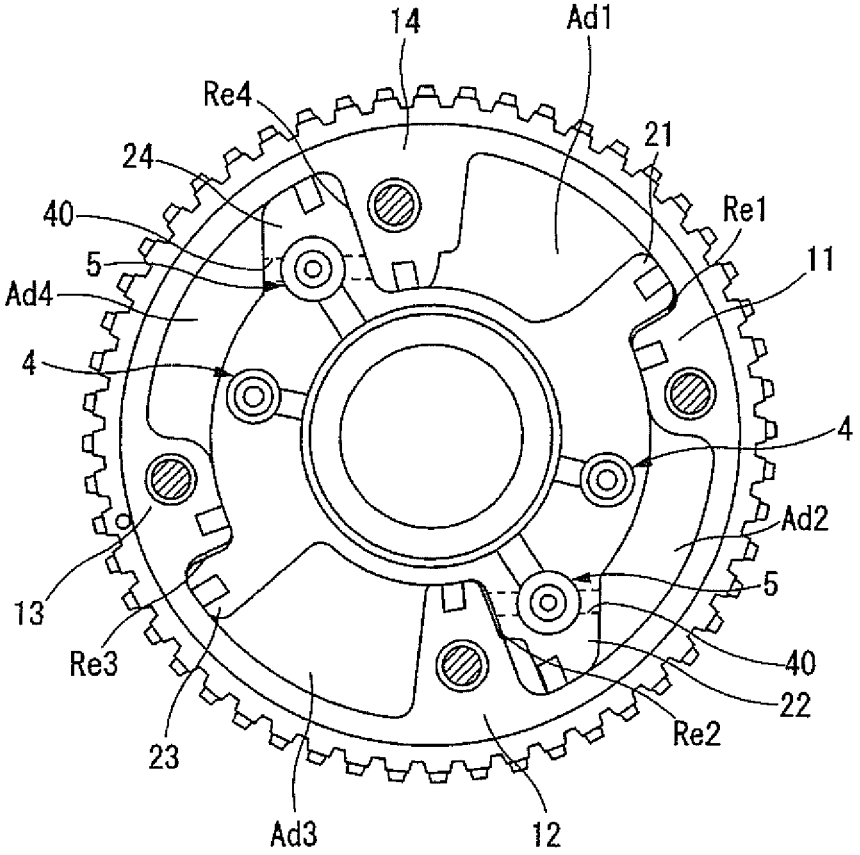
Figure 8B:
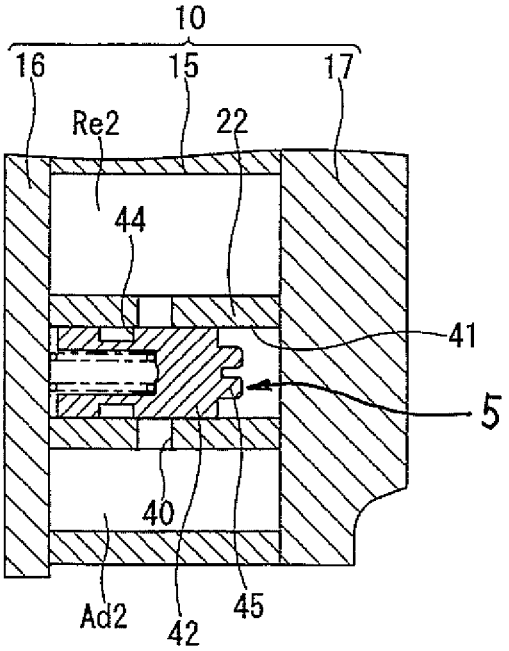
FIG. 8B is a cross-sectional view taken along the line C-C of FIG. 3 under the maximum phase-advance state.

The operation and effects of the valve timing control device of the shown embodiment are hereunder described in detail in reference to FIGS. 6A-6B, 7A-7B, and 8A-8B. FIGS. 6A-6B explain a communicated state of each of fluid-communication control mechanisms 5 employed in the second vane 22 and the fourth vane 24 under the maximum phase-retard state of vane rotor 20. FIGS. 7A-7B explain a communicated state of each of fluid-communication control mechanisms 5 employed in the second vane 22 and the fourth vane 24 under the lock state of vane rotor 20 locked at the predetermined intermediate angular position. FIGS. 8A-8B explain a non-communicated state of each of fluid-communication control mechanisms 5 employed in the second vane 22 and the fourth vane 24 under the maximum phase-advance state of vane rotor 20.

For instance, suppose that, during engine running, the engine has stalled unintendedly and thus the engine has stopped running without turning the ignition switch OFF, and thus the relative angular phase of vane rotor 20 has stopped or retained undesirably at a phase angle deviated from the predetermined intermediate angular position (as shown in FIG. 7A), corresponding to the lock position of vane rotor 20. In such a situation, with the oil pump 50 stopped operating, there is no supply of working fluid into each of pin housing holes 41, 41 of fluid-communication control mechanisms 5, and hence each of communication pins 42, 42 becomes held at its maximum advanced state. Thus, the annular groove 44 becomes brought into proper alignment (fluid-communication) with the communication groove 40 (see FIG. 6B). Accordingly, fluid-communication between the second phase-retard chamber Re2 and the second phase-advance chamber Ad2 partitioned by the second vane 22 and circumferentially adjacent to each other and fluid-communication between the fourth phase-retard chamber Re4 and the fourth phase-advance chamber Ad4 partitioned by the fourth vane 24 and circumferentially adjacent to each other become established. As a result of this, regarding the vane rotor 20, working fluid pressures act only on both the first vane 21 and the third vane 23.

Regarding the first vane 21 and the third vane 23, on which working fluid pressures act, the pressure-receiving surface area of the side face 21*a* of the first vane 21, facing the phase-advance chamber Ad1, and the pressure-receiving surface area of the side face 23*a* of the third vane 23, facing the phase-advance chamber Ad3, are dimensioned to be relatively greater than the pressure-receiving surface area of the side face 21*b* of the first vane 21, facing the phase-retard chamber Re1, and the pressure-receiving surface area of the side face 23*b* of the third vane 23, facing the phase-retard chamber Re3. By working fluid pressure acting on each of the side faces, both facing the phase-advance chamber side and having the relatively greater pressure-receiving surface area, the vane rotor 20 tends to rotate toward the phase-advance side. Thereafter, immediately when the predetermined intermediate angular position has been reached, lock pins 32 are brought into engagement with respective engagement holes 18, and hence relative rotation of vane rotor 20 is restricted.

Subsequently to the above, when restarting the engine, the ignition switch is turned ON and thus oil pump 50 is driven. Therefore, working fluid (hydraulic pressure) is supplied to all the phase-retard chambers Re1-Re4, the phase-advance chambers Ad1-Ad4, the pressure-receiving chambers 35, 35 (exactly, the stepped portions 32*c*, 32*c* of lock pins 32, 32) of lock mechanisms 4, and the pressure-receiving chambers 45, 45 (exactly, the stepped portions 42*c*, 42*c* of communication pins 42, 42) of fluid-communication control mechanisms 5. After this, immediately when the engine speed exceeds a given engine revolution speed and hence a given engine operating condition has been reached, by virtue of the difference between the pressure-receiving surface area "Sr" (see FIG. 4) of the stepped portion 32*c* of lock pin 32 and the pressure-receiving surface area "St" (see FIG. 5) of the stepped portion 42*c* of communication pin 42, first, communication pin 42 begins to retreat. Immediately after the given axial position of the retreating communication pin 42 has been reached, fluid-communication between the communication hole 40 and the annular groove 44 becomes blocked by the outer periphery of large-diameter portion 42*a* of communication pin 42 (see FIG. 8B).

Thereafter, lock pin 32 begins to retreat with a proper time lag from the time when a transition to a non-communicated state (a blocked state) of communication hole 40 by the communication pin 42 has occurred. In concert with an increase in retreating-movement of the lock pin, lock pin 32 moves out of engagement with the engagement hole 18. The restriction on rotary motion of vane rotor 20 relative to housing 10 becomes released. That is, fluid-communication between the communication hole 40 and the annular groove has already been blocked prior to the lock-pin release. Hence, vane rotor 20 can be controlled to a given relative angular phase determined based on the engine operating condition with hydraulic pressures (working fluid pressures) supplied to either phase-retard chambers Re1-Re4 or phase-advance chambers Ad1-Ad4.

As set out above, the valve timing control device of the embodiment is configured such that, immediately after the engine has been restarted, a transition to a blocked state (a shut-off state) of communication hole 40 by the fluid-communication control mechanisms 5 occurs prior to the release of restriction on rotary motion of vane rotor 20 relative to housing 10, restricted by means of the lock mechanisms 4. Therefore, it is possible to ensure or permit a more rapid rotary motion of vane rotor 20 towards the predetermined intermediate angular position by virtue of the pressure-receiving surface area difference of side faces of the first vane 21 and the pressure-receiving surface area difference of side faces of the third vane 23, in other words, due to the unbalanced pressure-receiving surface area configuration of the first vane and the third vane, when restarting the engine. Additionally, after the engine has been restarted, with communication holes 40, 40 blocked in advance and lock pins 32 disengaged (released) with a proper time lag from a transition to a blocked state of each of communication holes 40, 40, it is possible to apply an appropriately controlled hydraulic pressure to not merely some specified vanes (i.e., the first vane 21 and the third vane 23), but also to all of the vanes 21-24 with hydraulic pressures (working fluid pressures) supplied to either phase-retard chambers Re1-Re4 or phase-advance chambers Ad1-Ad4, thus ensuring a good control responsiveness of vane rotor 20.

Second Embodiment

Figure 9A:
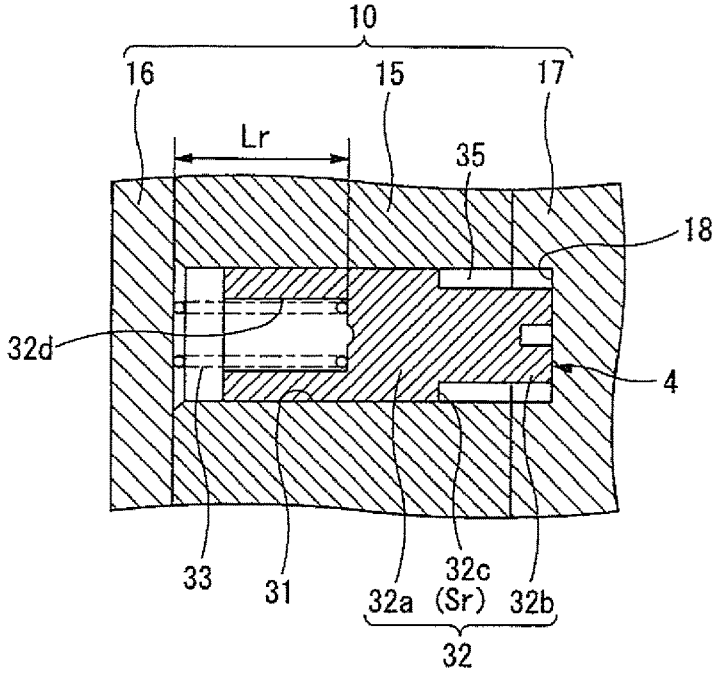
Figure 9B:
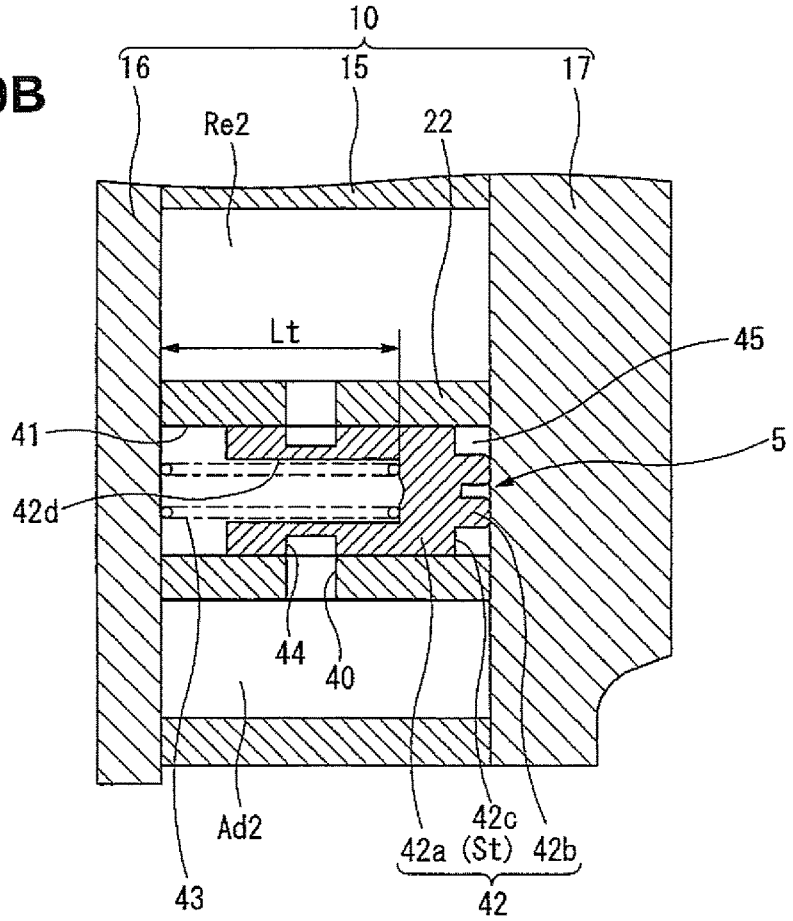
FIG. 9B is a view corresponding to FIG. 5 that shows the longitudinal cross-section of a fluid-communication control mechanism.

Referring now to FIG. 9, there is shown the internal combustion engine valve timing control device of the second embodiment according to the invention. The second embodiment differs from the first embodiment, in that the fluid-communication control mechanism of the second embodiment is somewhat modified from the configuration of fluid-communication control mechanism 5 of the first embodiment. By the way, the other configuration of the valve timing control device of the second embodiment is similar to that of the first embodiment. In explaining the second embodiment, for the purpose of simplification of the disclosure, the same reference signs used to designate elements in the first embodiment will be applied to the corresponding elements used in the second embodiment, while detailed description of the same reference signs will be omitted because the above description seems to be self-explanatory.

That is, in the second embodiment, the axial dimension "Lt" of the spring housing portion 42*d* of fluid-communication control mechanism 5 is set or dimensioned to be greater than the axial dimension "Lr" of the spring housing portion 32*d* of lock mechanism 4. Hence, the set spring load of coil spring 43 of fluid-communication control mechanism 5 is set to be less than the set spring load of coil spring 33 of lock mechanism 4. This enables communication pin 42 to retreat at an earlier time than retreating-movement of lock pin 32.

Accordingly, with the previously-discussed configuration of the second embodiment, it is possible to shut off the communication hole 40 by the fluid-communication control mechanisms 5 prior to unlocking (releasing) lock mechanism 4. Therefore, the device of the second embodiment can provide the same operation and effects as the first embodiment.

As discussed above, the device of the second embodiment is configured such that the set spring load of coil spring 43 of fluid-communication control mechanism 5 is set to be less than that of coil spring 33 of lock mechanism 4. In lieu thereof, the spring constant (spring stiffness) itself of coil spring 43 of fluid-communication control mechanism 5 may be set to be less than the spring constant (spring stiffness) of coil spring 33 of lock mechanism 4, for the purpose of enabling communication pin 42 to retreat at an earlier time than retreating-movement of lock pin 32.

It will be appreciated that the invention is not limited to the particular embodiments shown and described herein, but that various changes and modifications may be made. For instance, regarding both the lock mechanism 4 and the hydraulic-pressure supply-discharge mechanism 6, not directly concerned with essential features of the invention, concrete configurations of these two mechanisms 4 and 6 may be properly changed or altered freely depending on the type, specification and/or manufacturing costs of an internal combustion engine to which the valve timing control device of the invention can be applied.

In particular, regarding the lock mechanism 4, in addition to the lock mechanism as disclosed by reference to each of the first and second embodiments, in which the lock pin 32, which is inserted into the pin housing hole 31 formed in the rotor main body 25 as a through hole, is brought into engagement with the engagement hole 18 recessed in the inside surface of rear plate 17. In lieu thereof, another type of lock mechanism, as disclosed in Japanese patent provisional publication No. 2004-116410, for example, in which a platy lock member, which is slidably accommodated in a housing groove cut in a housing, is brought into engagement with an engagement groove cut or formed in the rotor outer periphery of a vane rotor.

Also, regarding the fluid-communication control mechanism 5, it will be appreciated that the invention is not limited to the particular embodiments shown and described herein, that is, the exemplified configurations such as the difference between the pressure-receiving surface area of lock pin 32 and the pressure-receiving surface area of communication pin 42 and the difference between the set spring load of coil spring 33 and the set spring load of coil spring 43. In other words, the device may be structured or configured such that the hydraulic pressure required for shutting off (blocking) the communication hole 40 is relatively less than the hydraulic pressure required for restriction release (unlocking) of the lock mechanism 4. Concrete configurations may be properly changed or altered freely depending on the specification of the device and the like.

Furthermore, regarding the fluid-communication control mechanism (FCCM) 5, in the first embodiment a plurality of fluid-communication control mechanisms 5, 5 are exemplified, but a plurality of fluid-communication control mechanisms are not always provided. That is, under a specified condition where at least one FCCM-equipped vane and at least one non-FCCM equipped vane, which is the same number as the at least one FCCM-equipped vane and has an unbalanced pressure-receiving surface area configuration, are provided, the same operation and effects as the first embodiment can be provided.

The other technical ideas grasped from the embodiments shown and described are enumerated and explained, as follows:

(a) The valve timing control device for the internal combustion engine as recited previously, is characterized in that the lock member and the communication pin are accommodated and arranged in a large-diameter portion formed between a prescribed pair of vanes of the plurality of vanes.

(b) The valve timing control device for the internal combustion engine as recited in the item (a), is characterized in that the lock member and the communication pin are accommodated in the large-diameter portion and arranged adjacent to each other.

The invention claimed is:

1. A valve timing control device for an internal combustion engine, comprising:

a housing adapted to be driven by torque transmitted from a crankshaft and having a plurality of shoes formed to protrude radially inward from an inner periphery of the housing for partitioning an internal space into a plurality of working chambers;

a vane rotor having a rotor configured to rotate relatively to the housing and a plurality of vanes fixedly connected to a camshaft together with the rotor and formed to protrude radially outward from an outer periphery of the rotor for partitioning the working chambers into phase-retard chambers and phase-advance chambers in cooperation with the shoes;

a hydraulically-operated lock interposed between the vane rotor and the housing and structured to restrict rotary motion of the vane rotor relative to the housing depending on an engine operating condition; and a hydraulically-operated fluid-communication control mechanism having a communication hole formed in at least one vane of the plurality of vanes so as to permit fluid-communication between the phase-retard chamber and the phase-advance chamber defined by the at least one vane through the communication hole, and configured to enable switching between a communicated state of the communication hole and a fluid-communication restricted state of the communication hole, wherein the hydraulically-operated fluid-communication control mechanism is located at a different position from the hydraulically-operated lock in a cross-section perpendicular to an axis of the vane rotor and is configured to switch, after starting of the engine, the communication hole from the communicated state to the fluid-communication restricted state at a relatively earlier time than a switching operation of the hydraulically-operated lock from a lock state, in which rotary motion of the vane rotor relative to the housing is restricted, to an unlock state, in which rotary motion of the vane rotor relative to the housing is enabled.

2. The valve timing control device for the internal combustion engine as recited in claim 1, wherein:

the hydraulically-operated lock and the hydraulically-operated fluid-communication control mechanism are operated by hydraulic pressure supplied from a same supply source.

3. The valve timing control device for the internal combustion engine as recited in claim 2, wherein:

the hydraulically-operated lock comprises:

a lock housing hole formed in one of the housing and the vane rotor;

a lock pin slidably accommodated in the lock housing hole;

an engagement hole formed in the other of the housing and the vane rotor and configured to permit a tip of the lock pin to be brought into engagement with the engagement hole; and a lock biasing spring provided to bias the lock pin toward the engagement hole.

4. The valve timing control device for the internal combustion engine as recited in claim 3, wherein:

the hydraulically-operated fluid-communication control mechanism comprises:

a pin housing hole formed in the vane rotor, and configured to open into the communication hole;

a communication pin slidably accommodated in the pin housing hole, and configured to switch the communication hole between the communicated state and a shut-off state depending on an axial position of the communication pin; and a pin biasing spring provided to bias the communication pin in one direction.

5. The valve timing control device for the internal combustion engine as recited in claim 4, wherein:

a pressure-receiving surface area of the lock pin and a pressure-receiving surface area of the communication pin are set such that the communication pin shuts off the communication hole prior to disengaging the lock pin from the engagement hole, when a same magnitude of hydraulic pressure acts on both the hydraulically-operated lock and the hydraulically-operated fluid-communication control mechanism.

6. The valve timing control device for the internal combustion engine as recited in claim 5, wherein:

the pressure-receiving surface area of the communication pin is set to be greater than the pressure-receiving surface area of the lock pin.

7. The valve timing control device for the internal combustion engine as recited in claim 5, wherein:

the communication pin is accommodated and arranged in a prescribed vane of the plurality of vanes.

8. The valve timing control device for the internal combustion engine as recited in claim 4, wherein:

a biasing force of the pin biasing spring is set to be less than a biasing force of the lock biasing spring.

9. The valve timing control device for the internal combustion engine as recited in claim 4, wherein:

the lock pin and the communication pin are accommodated and arranged in a large-diameter portion formed between a prescribed pair of vanes of the plurality of vanes.

10. The valve timing control device for the internal combustion engine as recited in claim 3, wherein:

the lock pin is formed into a substantially cylindrical shape; and the lock housing hole is formed into a through-hole shape in which the lock pin is slidably accommodated.

11. A valve timing control device for an internal combustion engine, comprising:

a housing adapted to be driven by torque transmitted from a crankshaft and having a plurality of shoes formed to protrude radially inward from an inner periphery of the housing for partitioning an internal space into a plurality of working chambers;

a vane rotor having a rotor configured to rotate relatively to the housing and a plurality of vanes fixedly connected to a camshaft together with the rotor and formed to protrude radially outward from an outer periphery of the rotor for partitioning the working chambers into phase-retard chambers and phase-advance chambers in cooperation with the shoes;

a hydraulically-operated lock interposed between the vane rotor and the housing and structured to restrict rotary motion of the vane rotor relative to the housing; and a hydraulically-operated fluid-communication control mechanism having a communication hole formed in at least one of the plurality of vanes so as to permit fluid-communication between the phase-retard chamber and the phase-advance chamber defined by the at least one vane through the communication hole, and configured to enable switching between a communicated state of the communication hole and a fluid-communication restricted state of the communication hole, wherein the hydraulically-operated fluid-communication control mechanism is located at a different position from the hydraulically-operated lock in a cross-section perpendicular to an axis of the vane rotor, and a hydraulic pressure required for restricting fluid-communication by way of the communication hole by the hydraulically-operated fluid-communication control mechanism is set to be relatively less than a hydraulic pressure required for a switching operation of the hydraulically-operated lock from a lock state, in which rotary motion of the vane rotor relative to the housing is restricted, to an unlock state, in which rotary motion of the vane rotor relative to the housing is enabled.

12. The valve timing control device for the internal combustion engine as recited in claim 11, wherein:

the hydraulically-operated lock and the hydraulically-operated fluid-communication control mechanism are operated by hydraulic pressure supplied from a same supply source.

13. The valve timing control device for the internal combustion engine as recited in claim 12, wherein:

the hydraulically-operated lock comprises:

a lock housing hole formed in one of the housing and the vane rotor;

a lock pin slidably accommodated in the lock housing hole;

an engagement hole formed in the other of the housing and the vane rotor and configured to permit a tip of the lock pin to be brought into engagement with the engagement hole; and a lock biasing spring provided to bias the lock pin toward the engagement hole.

14. The valve timing control device for the internal combustion engine as recited in claim 13, wherein:

the hydraulically-operated fluid-communication control mechanism comprises:

a pin housing hole formed in the vane rotor, and configured to open into the communication hole;

a communication pin slidably accommodated in the pin housing hole, and configured to switch the communication hole between the communicated state and a shut-off state depending on an axial position of the communication pin; and a pin biasing spring provided to bias the communication pin in one direction.

* * * * *